US011253011B2

(12) United States Patent
Carney

(10) Patent No.: US 11,253,011 B2
(45) Date of Patent: Feb. 22, 2022

(54) CROSSOVER MATERNITY PANEL

(71) Applicant: Ingrid & Isabel, LLC, San Francisco, CA (US)

(72) Inventor: Ingrid Carney, San Francisco, CA (US)

(73) Assignee: Ingrid & Isabel, LLC, San Francisco, CA (US)

( * ) Notice: Subject to any disclaimer, the term of this patent is extended or adjusted under 35 U.S.C. 154(b) by 235 days.

(21) Appl. No.: 16/295,925

(22) Filed: Mar. 7, 2019

(65) Prior Publication Data

US 2019/0200686 A1 Jul. 4, 2019

Related U.S. Application Data

(63) Continuation of application No. 14/636,688, filed on Mar. 3, 2015, now Pat. No. 10,226,083, which is a
(Continued)

(51) Int. Cl.
*A41D 1/21* (2018.01)
*A41D 1/22* (2018.01)
(Continued)

(52) U.S. Cl.
CPC ..... *A41D 1/21* (2018.01); *A41D 1/06* (2013.01); *A41D 1/22* (2013.01); *A41F 9/00* (2013.01)

(58) Field of Classification Search
CPC ..... A41D 1/22; A41D 1/06; A41F 9/00
(Continued)

(56) References Cited

U.S. PATENT DOCUMENTS

RE23,334 E 1/1951 Montmarquet
3,115,879 A 12/1963 Kaplan
(Continued)

FOREIGN PATENT DOCUMENTS

AU 2014318434 B2 3/2019
CA 155508 8/2015
(Continued)

OTHER PUBLICATIONS

Examiner's Report dated Nov. 6, 2014 in Canadian Design Application No. 155508, filed Mar. 5, 2014, 2 pages.
(Continued)

*Primary Examiner* — Timothy K Trieu
(74) *Attorney, Agent, or Firm* — Carr & Ferrell LLP

(57) ABSTRACT

The present invention relates to a crossover maternity panel that may be attached to any lower garment worn throughout pregnancy and post-partum body changes. The crossover maternity panel may be a belly panel comprised of a single piece of fabric or multiple pieces connected with seams, and wrap around from the front to the back of the wearer. The portions may overlap in the back of the wearer as they decrease in height to create a crossover triangular section that provides support to the lumbar region of the wearer. The crossover maternity panel may be attached to any lower garment such as a pant, short, skirt, skort, or the like. The flexible and stretchable material of the crossover maternity panel allows the wearer to have support for the enlarged belly, support for increased pressure and laxity on the wearer's sacroiliac joints and lower back, as well as comfort and mobility.

19 Claims, 12 Drawing Sheets

Related U.S. Application Data continuation-in-part of application No. 14/027,232, filed on Sep. 15, 2013, now Pat. No. 8,968,051.

(51) Int. Cl.
*A41F 9/00* (2006.01)
*A41D 1/06* (2006.01)

(58) Field of Classification Search
USPC ..... 450/154–155, 128; 2/227–228, 220, 221, 2/236
See application file for complete search history.

(56) References Cited

U.S. PATENT DOCUMENTS

| | | | | |
|---|---|---|---|---|
| 3,213,856 | A | 10/1965 | Gakle | |
| 3,273,563 | A | 9/1966 | Bonang | |
| 3,393,675 | A * | 7/1968 | Trznadel | A61F 5/26 128/101.1 |
| 3,396,730 | A | 8/1968 | Fox | |
| 3,806,953 | A | 4/1974 | Kalil | |
| 4,506,390 | A | 3/1985 | Stern | |
| 5,050,244 | A | 9/1991 | Kleinman | |
| 5,105,474 | A * | 4/1992 | Skinner | A41D 13/0575 2/2.17 |
| D353,890 | S | 12/1994 | McKeel | |
| 5,398,667 | A | 3/1995 | Witt | |
| 5,571,039 | A | 11/1996 | Ford | |
| D380,588 | S | 7/1997 | Chen | |
| 5,689,832 | A | 11/1997 | Head | |
| D404,490 | S | 1/1999 | Tripolsky | |
| 6,048,253 | A | 4/2000 | Larsen | |
| 6,105,175 | A | 8/2000 | Conti et al. | |
| 6,108,819 | A | 8/2000 | DeBaene et al. | |
| D432,758 | S | 10/2000 | Harris | |
| D437,416 | S | 2/2001 | Slautterback | |
| 6,430,752 | B1 | 8/2002 | Bay | |
| 7,306,505 | B2 | 12/2007 | Barbour et al. | |
| D598,637 | S | 8/2009 | Schildkraut | |
| 7,591,706 | B2 | 9/2009 | Barbour et al. | |
| D622,936 | S | 9/2010 | Baker | |
| D628,300 | S | 11/2010 | Caden | |
| D638,948 | S | 5/2011 | Janzon | |
| D661,872 | S | 6/2012 | Iamartino | |
| D662,281 | S | 6/2012 | Iamartino | |
| 8,191,177 | B1 * | 6/2012 | Carney | A41D 1/21 2/311 |
| D665,470 | S | 8/2012 | Galbraith | |
| 8,266,723 | B2 | 9/2012 | Frandsen et al. | |
| 8,276,216 | B2 | 10/2012 | Carney | |
| D683,042 | S | 5/2013 | Quisenberry | |
| D686,799 | S | 7/2013 | Farina et al. | |
| 8,517,794 | B2 | 8/2013 | Thompson | |
| D718,516 | S | 12/2014 | Zureikat | |
| 8,968,051 | B1 | 3/2015 | Carney | |
| 9,161,854 | B2 | 10/2015 | Fruscione-Loizides | |
| D749,230 | S | 2/2016 | Safko et al. | |
| D792,677 | S | 7/2017 | Carney | |
| 10,226,083 | B2 | 3/2019 | Carney | |
| 2008/0172769 | A1 | 7/2008 | Herget | |
| 2008/0295217 | A1 | 12/2008 | Hendrickson et al. | |
| 2008/0295225 | A1 | 12/2008 | Hendrickson et al. | |
| 2009/0049583 | A1 * | 2/2009 | Stones | A41F 5/00 2/221 |
| 2010/0235965 | A1 | 9/2010 | Frandsen et al. | |
| 2010/0275339 | A1 | 11/2010 | Huc | |
| 2010/0294267 | A1 | 11/2010 | Terruso | |
| 2011/0239353 | A1 | 10/2011 | Carney | |
| 2012/0060253 | A1 | 3/2012 | Bergin (nee Madonna) et al. | |
| 2013/0095730 | A1 | 4/2013 | Jensen | |
| 2013/0097764 | A1 | 4/2013 | Michel | |
| 2013/0254971 | A1 | 10/2013 | Galluzzo et al. | |
| 2015/0079877 | A1 | 3/2015 | Carney | |
| 2015/0173424 | A1 | 6/2015 | Carney | |

FOREIGN PATENT DOCUMENTS

| | | | |
|---|---|---|---|
| CA | 162520 | | 8/2015 |
| CD | 002419713 | | 3/2014 |
| EP | 3043664 | A1 | 7/2016 |
| EP | 3043664 | B1 | 7/2018 |
| GB | 4005718 | | 1/2008 |
| HK | 1226915 | A | 10/2017 |
| HK | 1226915 | | 2/2019 |
| JP | 3109102 | U | 5/2005 |
| JP | D1284000 | S | 10/2006 |
| JP | D1477712 | S | 8/2013 |
| WO | WO2015039042 | | 3/2015 |

OTHER PUBLICATIONS

Patent Cooperation Treaty Application No. PCT/US2014/055693, "International Search Report" and "Written Opinion of the International Searching Authority," dated Sep. 15, 2014, 9 pages.

At-Home Postpartum Wrap—Helping Your Body Find Its Natural Balance Again, [online], Announced Apr. 5, 2013, [retreived on Mar. 3, 2016], Retreived from the Internet: <http://fitness.bellypilates.com/2013/04/05/at-home-post-partum-wrap-helping-your-body-find-its-natural-balance-again>, 1 page.

"Extended European Search Report" and "Written Opinion," European Patent Application No. 14843479.8, dated Jan. 31, 2017, 5 pages.

"Notice of Allowance," European Patent Application No. 14843479.8, dated Dec. 6, 2017, 6 pages.

"Office Action," Australian Patent Application No. 2014318434, dated Sep. 5, 2018, 3 pages.

"Notice of Allowance," Australian Patent Application No. 2014318434, dated Nov. 28, 2018, 3 pages.

"Office Action," Canada Patent Application No. 2924513, dated Jan. 26, 2021, 5 pages.

* cited by examiner

| Spandex Content | Other Fabric Content | Fabric Density |
|---|---|---|
| 5-30% spandex | 70-95% cotton | 130-350 $g/m^2$ |
| 5-30% spandex | 70-95% cotton/polyester blend | 130-350 $g/m^2$ |
| 5-30% spandex | 70-95% Nylon | 130-350 $g/m^2$ |
| 5-30% spandex | 70-95% polyester | 130-350 $g/m^2$ |
| 5-30% spandex | 70-95% Rayon (viscose or Modal or Bamboo) | 130-350 $g/m^2$ |
| 5-30% spandex | 70-95% blended polyester/cotton/viscose | 130-350 $g/m^2$ |
| 5-30% spandex | 70-95% blended polyester/nylon/viscose | 130-350 $g/m^2$ |
| 5-30% spandex | 70-95% blended polyester/nylon | 130-350 $g/m^2$ |

FIG. 3

TEST 1

| TESTING RESISTANCE OF: | |
|---|---|
| - A to B | 133.7 |
| - A to C | 145.2 |
| - A to D | 126.0 |
| - A to E | |
| - A to F | 121.8 |
| - A to G | 144.4 |

TEST 2

A - Single Layer Test

Testing Resistance of:

| | | |
|---|---|---|
| - A to B | 46.8 | 52.2 |
| - B to C | 51.6 | 49.1 |
| - C to A | 54.7 | 50.1 |

B - Double Layer Test

Testing Resistance of:

| | | |
|---|---|---|
| - A to B | 99.7 | 88.4 |
| - B to C | 85.1 | 78.7 |
| - C to A | 96.8 | 83.4 |

CROSSOVER MATERNITY PANEL

CROSS-REFERENCE TO RELATED APPLICATIONS

The present application is a Continuation of, and claims the priority benefit of, U.S. patent application Ser. No. 14/636,688 filed on Mar. 3, 2015, and granted on Mar. 12, 2019 as U.S. Pat. No. 10,226,083 entitled "Crossover Maternity Panel with Insert", which in turn is a Continuation-in-Part of, and claims the priority benefit of, U.S. patent application Ser. No. 14/027,232 filed on Sep. 15, 2013, and granted on Mar. 3, 2015 as U.S. Pat. No. 8,968,051 entitled "Crossover Maternity Panel". The disclosures of the above-referenced applications are incorporated herein by reference in their entirety for all purposes.

TECHNICAL FIELD

The present invention relates generally to a garment worn during different stages of pregnancy and post-partum body changes.

BACKGROUND

The shape and weight of a woman's body changes dramatically during, and after pregnancy. In particular, a pregnant woman's belly grows to accommodate the growth of her baby. As a pregnant woman's baby grows, its weight pushes outward and downward in her body. This can cause pressure and discomfort around the woman's lumbar region, including the pelvic area and sacroiliac joints.

Throughout pregnancy, back pain can be a common complaint of pregnant women, and is generally characterized by discomfort in the lower lumbar region. Discomfort in this region may be contributed to loosened ligaments as a result of pregnancy, and movement of the sacroiliac joints.

The sacroiliac joints are weight-bearing joints that distribute weight from the spine to the lower extremities through the hip joints. The human body has two sacroiliac joints (or SI joints), one on the left and one on the right side of the body, that are joined by ligaments. Most body types display a small dimple on each side of the lower back at the SI joint. Generally, this joint moves very little.

For pregnant women, hormonal changes associated with pregnancy may cause a woman's ligaments to become more lax, and her sacroiliac joints to become more relaxed. The softening of the dense ligaments of the SI joints allows the pelvic outlet to expand during childbirth. As a pregnant woman's belly grows, the rib cage expands to make room for the growing fetus, as well as allowing the pelvis to expand in order for the baby to be delivered. However, this increased ligament laxity can cause instability at the SI joints during later stages of pregnancy and postpartum. After delivery, the woman's body continues its metamorphosis as it reshapes into its normal size over weeks or months. During this time, the SI joints need to continue to be supported. Furthermore, as the belly grows, the woman's center of gravity shifts forward. Many people compensate for this by leaning back, which can also strain the muscles in the lower back and contribute to back pain during pregnancy.

In the prior art, various maternity pants exist that serve to accommodate a woman's growing belly size with a belly panel. The belly panel may cover a portion of a woman's belly, or substantially all of it. However, these belly panels merely serve to allow bottom garments to accommodate a pregnant belly and do not actually provide any support for the belly or relieve any of the pressure on the woman's lumbar region on the back. Maternity belts are available, and are generally much tighter and constricting around and below the belly, and require adjusting. The belts are worn over or under clothing, and are often bulky with straps that may wrap around a woman's belly, they may wrap in between her legs, and are often secured with Velcro, buckles and other closures to secure a tight fit. They are intended for women with severe back pain due to pregnancy.

Accordingly, a need exists for a maternity panel that is attached to any type of lower garment wherein the maternity panel can stretch and grow with a woman's changing body shape throughout pregnancy and postpartum, while also providing lower back support, comfort, and mobility.

SUMMARY

During pregnancy and afterwards, a woman's body changes shape and size dramatically. A pregnant woman slowly develops an oversized load in the front due to the enlarged belly that pulls the pelvis forward and puts stress and load on the lower back. Also, a pregnant woman's body may experience increased laxity that may cause instability in the sacroiliac joints and connecting ligaments.

In embodiments of the present invention, a crossover maternity panel is disclosed that comprises one or more fabric portions that may cover substantially a woman's entire belly in the front to provide for outward and upward stretch and support for the enlarged belly, or may be folded down to provide for under belly support. The panel also wraps around a pregnant woman's enlarged belly and reduces in height in the back of the woman, as each side portion of the panel overlaps and creates a triangular crossover portion that provides additional support to the lumbar region of the wearer. An insert may also be placed in the triangular crossover portion to provide increased support to the lumbar region of the wearer.

As the pregnant belly grows throughout pregnancy, the flexible and stretchable material of the crossover maternity panel stretches forward and outward, while retaining its original shape. The forward stretch of the panel forces the panel to stretch forward. The result is forward compression at the back portion of the panel, with the greatest forward compression occurring within the triangular portion of the panel. This compression provides gentle pressure on the lower back of the wearer as the belly grows which offsets the forward pressure from the baby. The gentle pressure also gives improved holding stability to the sacroiliac joint, providing gentle support, and therefore allowing the wearer to be more comfortable and mobile. In various embodiments, the crossover maternity panel may also be worn with the belly panel folded down to provide front support and lift of the enlarged belly from below.

DESCRIPTION OF THE DRAWINGS

FIG. 3 is a chart depicting exemplary fabric blends for various embodiments of a crossover maternity panel.

DETAILED DESCRIPTION

Figure 1:
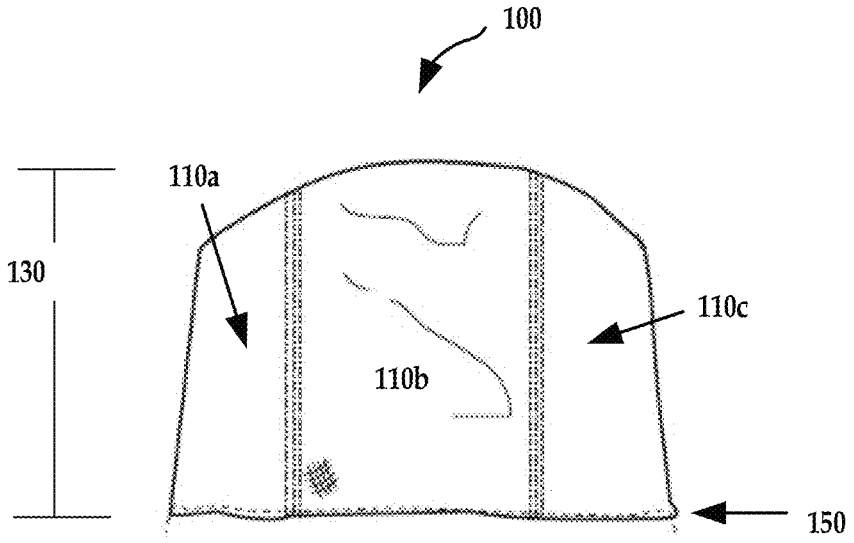
FIG. 1 illustrates an exemplary front view of one embodiment of a crossover maternity panel.

In the drawings, FIG. 1 illustrates an exemplary front view of one embodiment of a crossover maternity panel 100 (also referred to as a crossover belly panel 100). The crossover maternity panel 100 may be manufactured from a flexible, stretchable fabric material capable of being expanded and stretched to be firmly but comfortably worn around the abdomen of a woman during pregnancy or postpartum approximately at the waist. The fabric may also be antimicrobial and/or moisture wicking. The crossover maternity panel 100 may be worn as a standalone garment, or may be attached to any type of lower garment that a woman would wear, including, but not limited to, pants of any length or fabric, jeans, capri, shorts, leggings, active wear including active pants, skirt, skort, or hosiery.

The crossover belly panel 100 may be manufactured from a double ply (or double layer) of fabric material that stretches with the body as it changes through pregnancy and afterwards, yet still substantially maintains its elasticity and shape. The crossover belly panel 100 may further be comprised of one or more fabric portions 110*a*, 110*b*, and 110*c* (also 410*a*, 410*b*, and 410*c* in FIGS. 4 and 5, and 1010*a*, 1010*b* and 1010*c* in FIGS. 10 and 11). Each of these fabric portions may be approximately rectangular in shape, or have a curved top edge and/or bottom edge at the waist 150. The fabric portions may be connected to each other with a seam, such as a flatlock seam or princess seam. The waist 150 of the crossover maternity panel 100 may be defined by a seam, a hemline, a fold in the fabric of the garment, a change in pattern, design or color of the garment, or by any other means. In exemplary embodiments, the waist 150 may range from approximately 8-26 inches across when the crossover maternity panel 100 is laid on a flat surface. Although three fabric portions are depicted here, fewer or more fabric portions may also be utilized.

In various other embodiments, the crossover belly panel 100 may be manufactured from seamless fabric. The crossover belly panel 100 may be manufactured from a single piece of circularly knitted fabric such as a single knit or double knit tube. In one embodiment, the crossover belly panel 100 may be manufactured using an electronic circular knitting machine or electronic warp knitting machine for seamless products, such as the single jersey, double jersey, or warp seamless machines produced by Santoni S.p.A. of Brescia, Italy. The knitting machine may have a cylinder having various shapes and properties. The cylinder may also allow the use of different fabrics, yarn types, needles, and knitting structures. Where a seamless tube is used to create the crossover belly panel 100, the bottom to top center back of the tube may be cut. Attaching the top corners from the center back cut as the anchor points on the rear of the bottom of the panel in an overlapping fashion creates the crossover portion and the triangular support portion on the crossover belly panel 100.

The crossover belly panel 100 may be manufactured such that one size fits most users, although two or more different sizes may also be provided for different sizes of women. Sizes may be designated by numbers or letters. For example, the garment may be available in different sizes, such as sizes 0-4, wherein size 0 is the smallest available garment with the smallest measurement and size 4 is the largest garment with the largest measurement. Alternatively, sizes may be designated by letters such as "XS" indicating an extra small garment, "S" for a small garment, "M" indicating a medium sized garment, "L" indicating a large sized garment, and "XL" indicating an extra large sized garment. A crossover belly panel 100 of a single size may fit a particular pregnant woman as her body shape changes throughout her pregnancy and postpartum, such that a woman does not need to purchase different sizes for the different stages of pregnancy and postpartum.

In exemplary embodiments, the crossover belly panel 100 is of knit fabric, in basic colors typical of bottom-half clothing today such as black, khaki, denim-color blue, grey, and white. The crossover maternity panel 100 may also be made in various and seasonal patterns and colors if desired. The crossover belly panel 100 may also be textured or adorned with any decoration known in the art such as lace, beads, or decorative stitching. The seams of the crossover belly panel 100 may be of the same color as the fabric of the pant, or of a different color. The crossover belly panel 100 may be of the same color or design as the bottom garment it is attached to, or a different color or design.

In exemplary embodiments, the knit fabric of the crossover maternity panel 100 may be any knit fabric known in the art such as double knit fabric, single knit fabric, baby rib knit, interlock knit, fleece, stretch velvet, or textured novelty knit. In one embodiment, the knit fabric is jersey fabric. In exemplary embodiments, the crossover belly panel 100 may be made from any fiber content yarn knit into fabric made with a spandex content of between 5%-30%. The remaining 70%-90% of the crossover belly panel 100 may be comprised of cotton, organic cotton, nylon, rayon, or any other suitable material. The flexible, stretchable material of the crossover belly panel 100 may have a fabric density (also sometimes referred to as weight) ranging from 130 grams/square meter to 350 grams/square meter (g/m$^2$). In one embodiment, the crossover belly panel 100 may be of a stretchable, knit nylon/spandex (elastane) blend. The knit nylon/spandex blend may include 70-95% nylon and 5-30% spandex. In various other embodiments, the fabric for the crossover belly panel 100 may be a blend of any of cotton, organic cotton, spandex, or nylon. Other suitable fabrics may also be used such as polyester, lyocel, or rayon (polyamide or viscose). FIG. 3 depicts a chart showing various other material blends and fabric densities of embodiments of the crossover belly panel 100.

Figure 4:
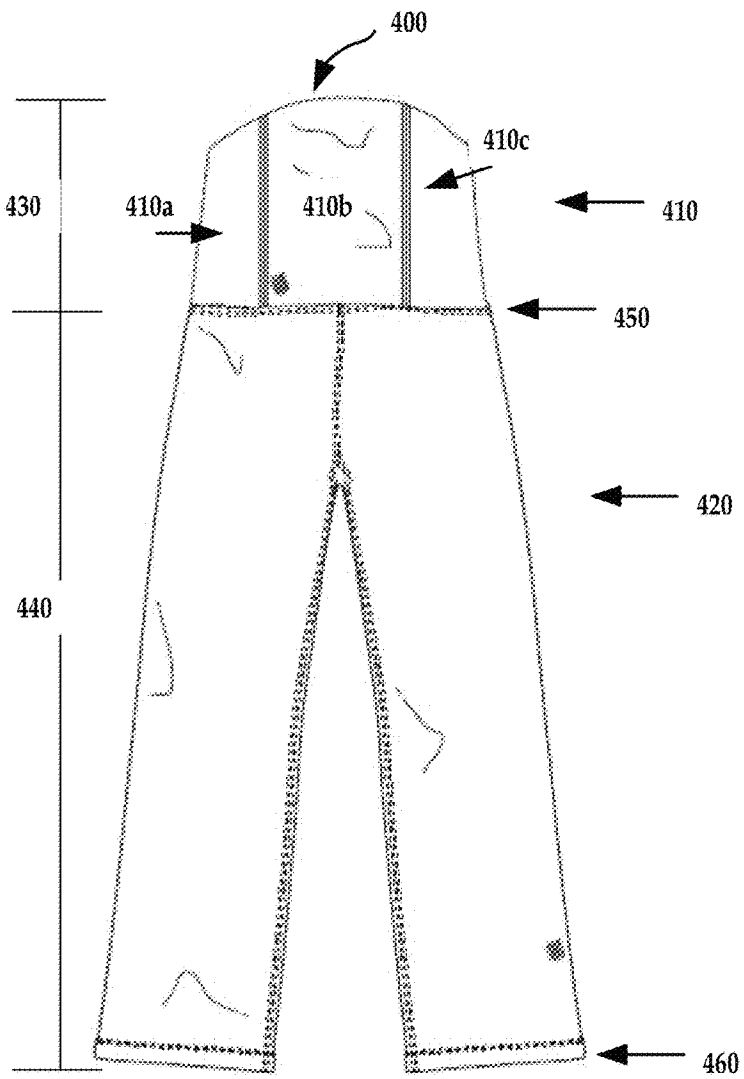
FIG. 4 illustrates an exemplary front view of one embodiment of a pant incorporating a crossover maternity panel.
Figure 6:
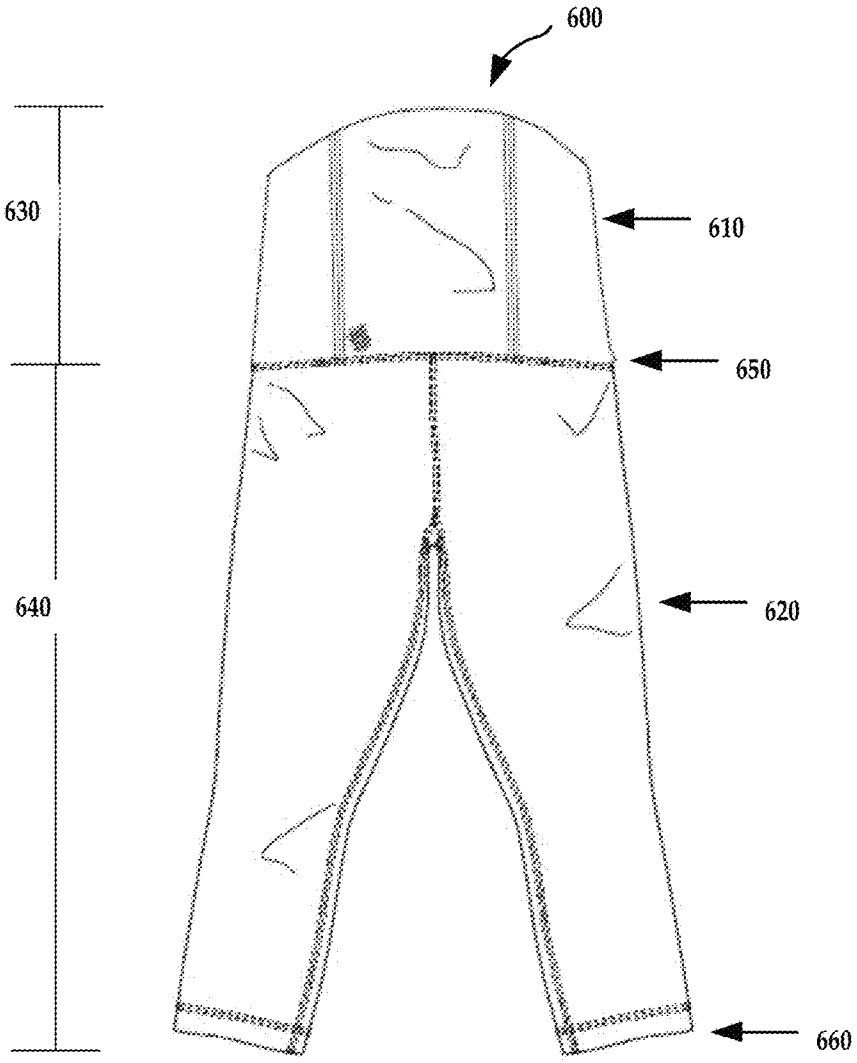
FIG. 6 illustrates an exemplary front view of another embodiment of a pant incorporating a crossover maternity panel.
Figure 8:
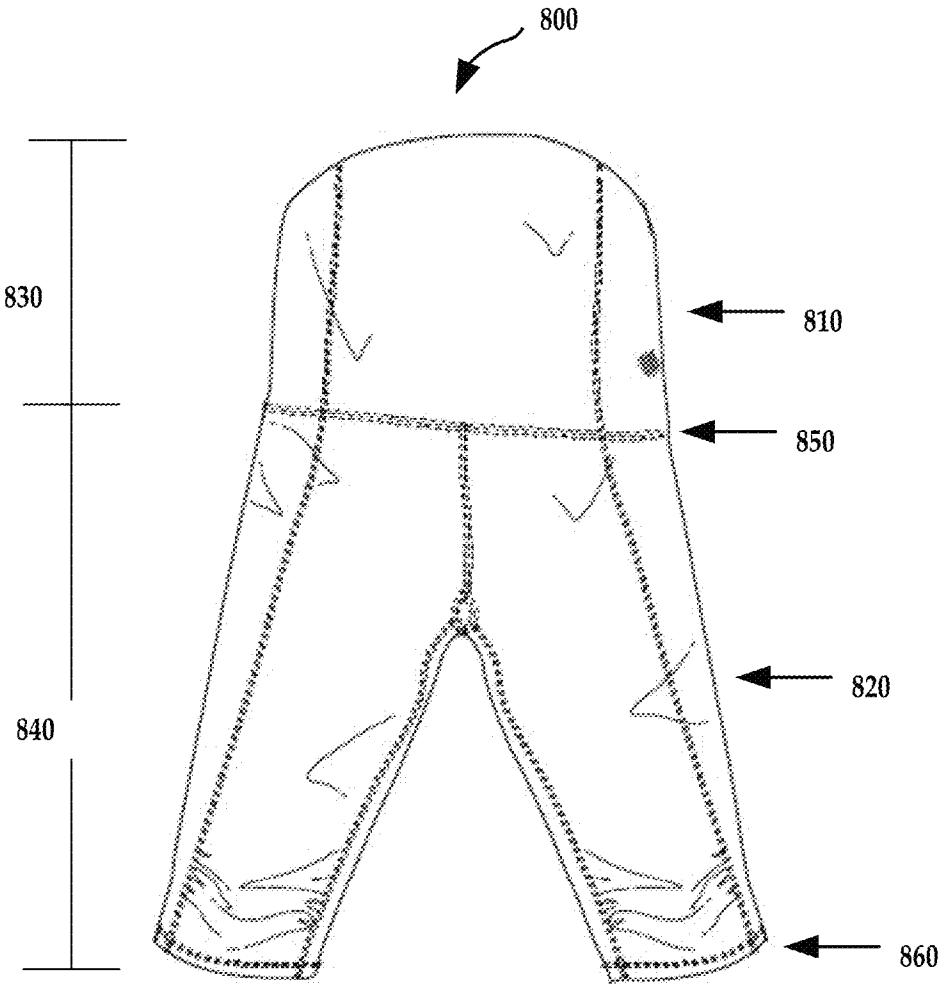
FIG. 8 illustrates an exemplary front view of a third embodiment of a pant incorporating a crossover maternity panel.
Figure 10:
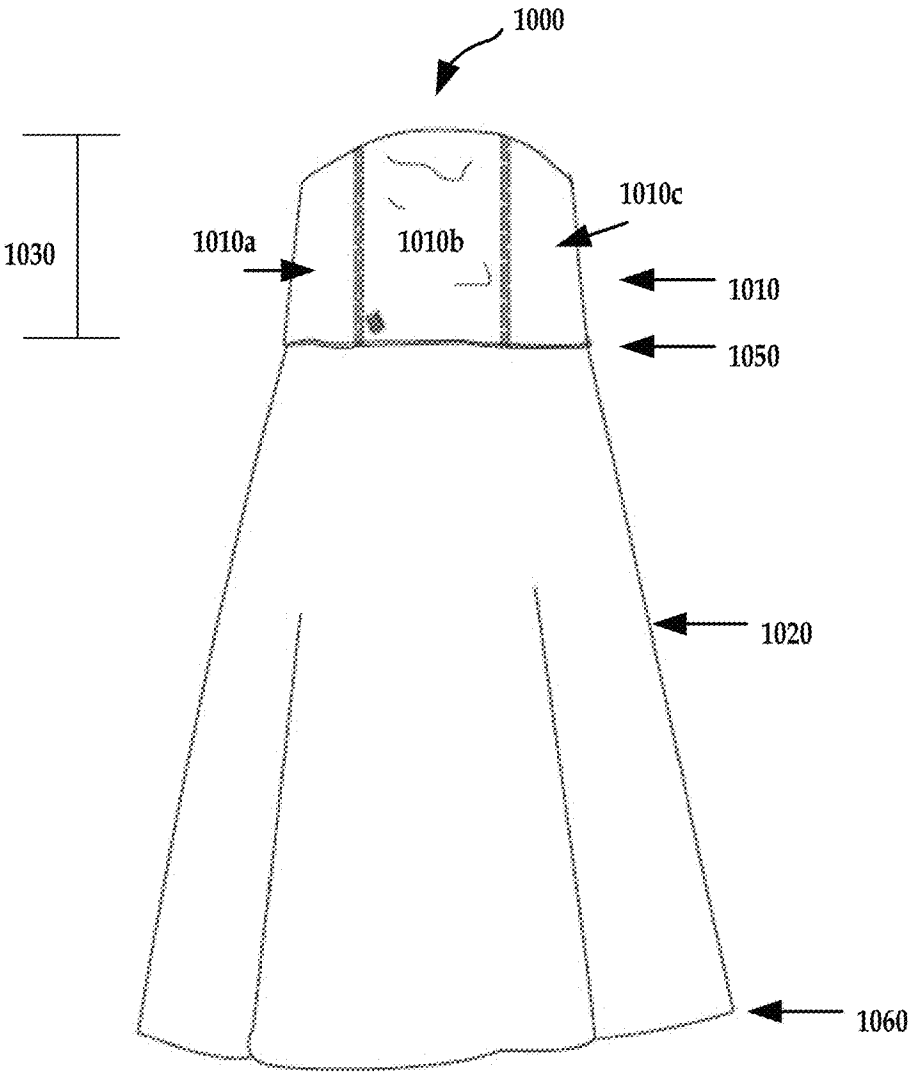
FIG. 10 illustrates an exemplary front view of one embodiment of a skirt incorporating a crossover maternity panel.

The crossover belly panel 100 may range from approximately 8 inches to 16 inches in height 130 at the front of the woman's body (also height 430 in FIG. 4, height 630 in FIG. 6, height 830 in FIG. 8, and height 1030 in FIG. 10). The crossover belly panel 100 is of a circumference that will accommodate a pregnant woman of a designated size range, the circumference preferably being between 16 and 52 inches before the fabric is stretched.

The crossover belly panel 100 may also include a silicone strip or coating applied to an interior area of the garment. The silicone strip or coating may be applied to help the garment adhere or stick to the body of the woman and/or prevent the garment from moving during use. The silicone strip or coating may be applied to the garment using any technique known in the art such as knife coating, dip/immersion coating, rotogravure coating, extrusion, or spraying. The silicone strip or coating may have a height of about ¼ inch to 1 inch.

Figure 2B:
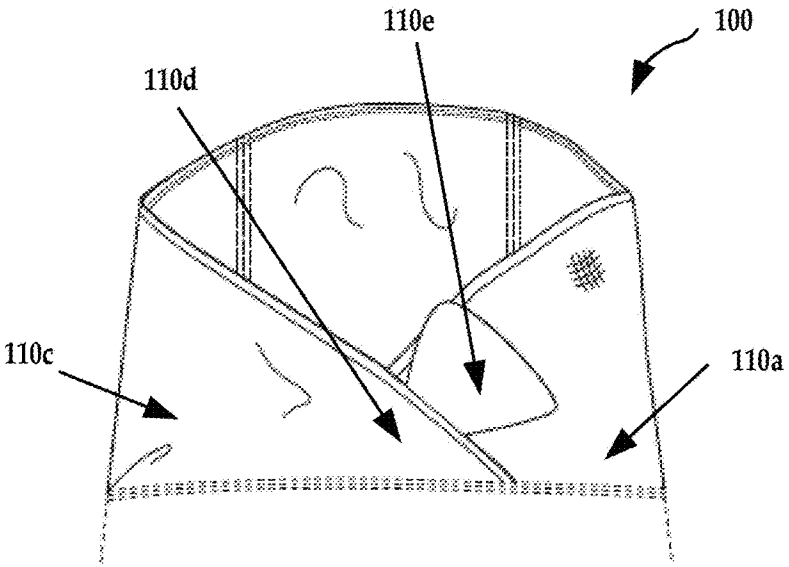
FIG. 2B illustrates another exemplary rear view of one embodiment of a crossover maternity panel.
Figure 2A:
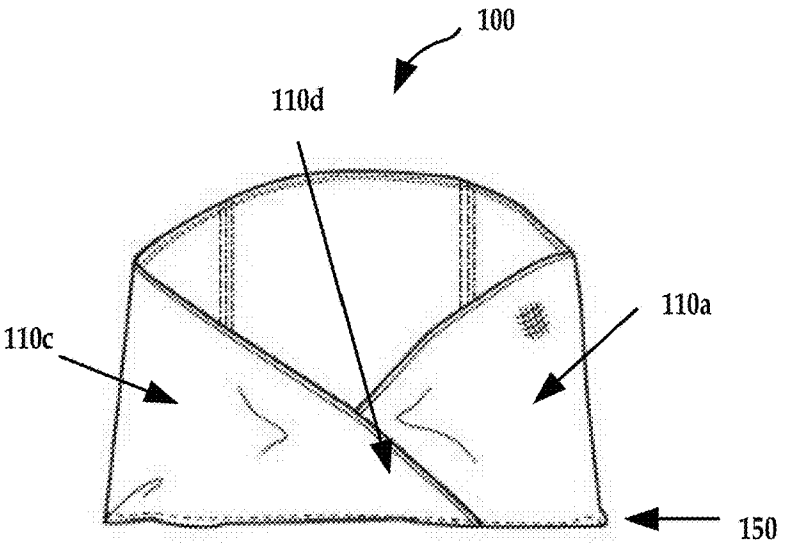
FIG. 2A illustrates an exemplary rear view of one embodiment of a crossover maternity panel.

FIG. 2A illustrates an exemplary rear view of one embodiment of the crossover maternity panel 100. In the rear view, the crossover portion of the crossover belly panel 100 is shown. The crossover portion may be manufactured such that the portion on the wearer's left side 110*c* overlaps over the portion on the wearer's right side 110*a*. In other embodiments, the portion on the wearer's right side 110*a* may overlap over the portion on the wearer's left side 110*c*. The overlapping of the two portions creates a triangular support portion 110*d* which may fall approximately at the top of the iliac crest (top of pelvis) of the wearer. The overlapping of the two portions may occur at the midline of the back of the wearer. Each portion 110*a* and 110*c* may connect with the waist 150 at 1 to 10 inches to the left of the midline of the back of the wearer, and 1-10 inches to the right of the midline of the back of the wearer. The seam at the waist 150 may be strategically located to meet approximately at the iliac crest of the wearer of the garment. While combining seam and paneling with structure and anatomical location, the crossover maternity panel 100 is delicately engineered and manufactured to alleviate strain on the abdomen and lumbar region of the wearer while adding comfort, mobility, and support.

The combination of a double ply crossover belly panel 100 with deliberately placed structural seams at the waist level 150 on the lower back provide increased comfort and mobility for the wearer due to the combination of the triangular support portion 110*d* and the elasticity of the fabric blend. The crossover belly panel 100 traces the contour of the lower back of the wearer to sweep up and around to the front of the wearer and top of the belly using the lumbar region as a natural platform. The crossover belly panel 100 may consist of a double layer of fabric to hold the belly with comfort during the physical changes of pregnancy. Thus, the triangular support portion 110*d* may provide a total of four layers of fabric in the overlapping region to provide additional support to the wearer's lower back. The sides of the crossover belly panel 100 may additionally provide a built-in framework for the expanding belly. Furthermore, a seam at the waist 150 may be in a subtle arc shape instead of strictly horizontal, such that the crossover belly panel 100 may provide additional comfort and support to the wearer's belly, and be in an optimal location for the best common fit. In other embodiments, the crossover belly panel 100 may also be manufactured from a single layer of fabric.

As the belly area of a pregnant woman grows, the crossover belly panel 100 may also expand due to its stretchable and flexible fabric makeup. The expansion of the crossover belly panel 100 may allow it to become more snug, and provide a lifting feeling to the front of the wearer's belly while also simultaneously providing a subtle inward push against the lumbar region of the wearer at the triangular support portion 110*d*. This may provide additional support to the wearer's entire abdomen region, including belly and lumbar region, as the belly grows and additional support is needed. Elastic materials necessarily tend to recoil and pull back to their original shape after they are expanded. Thus, as the belly of the wearer expands, the elasticity of the fabric will cause the crossover belly panel 100 to have increased resistance in the triangular support portion 110*d*, and thus provide more support to the wearer's lower back, including the lumbar region and sacroiliac joints. Furthermore, the resistance is even greater with increasing layers of fabric. Thus, the multiple layers of fabric in the triangular support portion 110*d* provide even greater resistance in that area and provide additional support in the strategic lower back region for the wearer.

Figure 16:
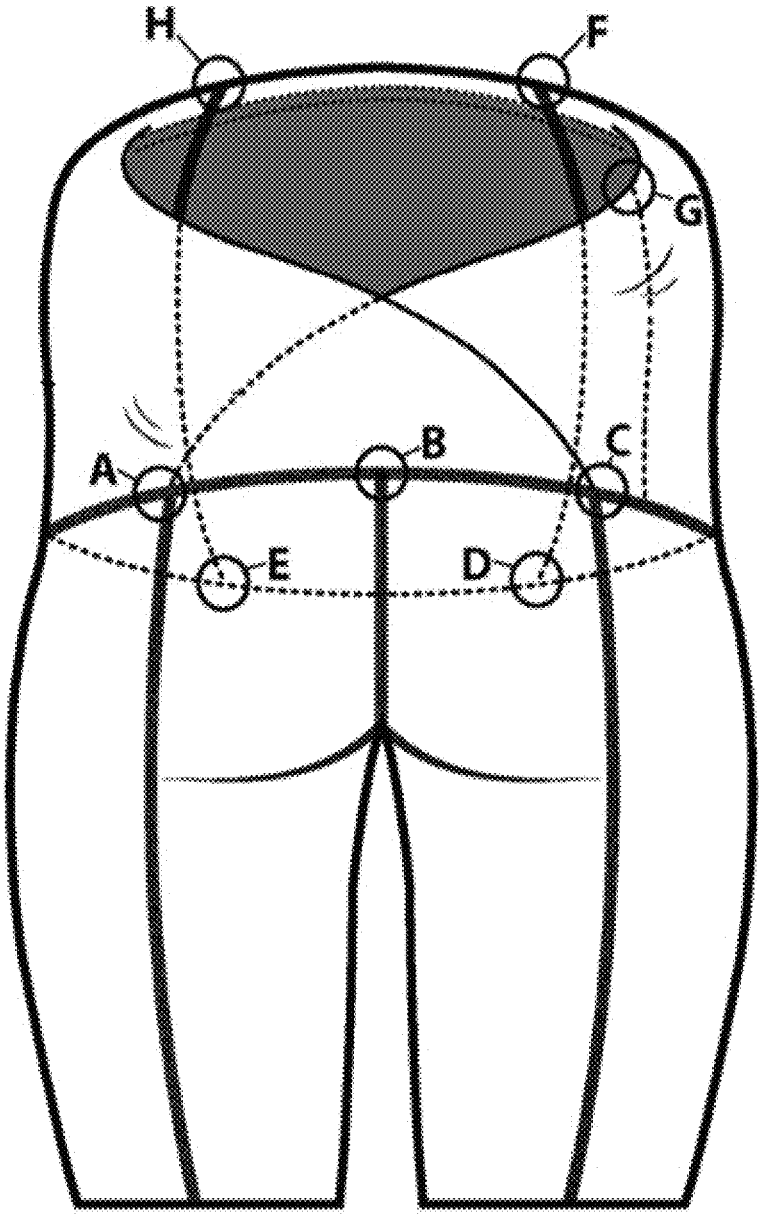
FIG. 16 illustrates an exemplary rear view of resistance test reading points on a crossover maternity panel.
Figures 17, 18:
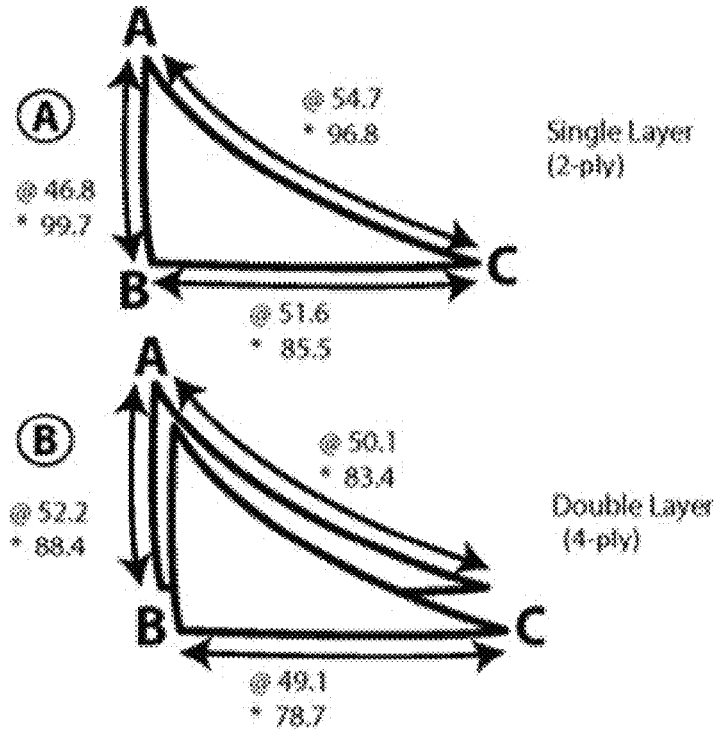
FIG. 17 illustrates exemplary resistance test results corresponding to resistance test reading points of the crossover maternity panel of FIG. 16.
FIG. 18 illustrates exemplary resistance test results corresponding to resistance test reading points of the crossover maternity panel of FIG. 16.

Resistance tests have shown that the more the fabric stretches, the stronger the resistance is in the fabric. Resistance tests measure resistance in pounds of force per square inch. The triangular support portion 110*d* has two or more layers of fabric strategically located at the lower lumbar region, which acts as the anchor point at which the wearer receives the most support. Through the physical growth of pregnancy, the wearer receives more support as her belly expands. FIG. 16 illustrates an exemplary rear view of resistance test reading points on a crossover maternity panel. FIGS. 17 and 18 show exemplary test results corresponding to the resistance test reading points depicted in FIG. 16 that demonstrate the increasing support provided by the crossover belly panel 100.

In other embodiments, the two overlapping portions 110*a* and 110*c* may be stitched together at the triangular support portion 110*d*, such that the triangular support portion 110*d* is a distinct fabric portion from the remainder of the crossover maternity panel 100. In further embodiments, the upper portion of the fabric portion 110*c* that comprises the triangular support portion 110*d* may have a slit to allow for the insertion of another material into the triangular support portion 110*d*.

FIG. 2B depicts an exemplary rear view of a crossover maternity panel 100 with an insert 110*e* in the triangular support portion 110*d*. In various embodiments, the insert 110*e* is removable by the manufacturer or wearer of the garment, or stitched into the triangular support portion 110*d*. While the insert is depicted in FIG. 2B as being of a substantially triangular shape, the insert may also be of any other shape or size, to partially or completely fill the triangular support portion 110*d* of the crossover belly panel 100.

The triangular support portion 110*d* may be composed of four layers of fabric where the fabric portions 110*c* and 110*a* overlap. In the exemplary embodiment depicted in FIG. 2B, the insert 110*e* is placed between the fabric portions 110*a* and 110*c*, i.e. between the second and third fabric layers of the crossover belly panel 100. In one embodiment, the insert 110*e* may be placed into the triangular support portion 110*d* by the manufacturer of the garment and the triangular support portion 110*d* may be stitched closed such that the insert 110*e* is not removable by the wearer of the garment. In other embodiments, the opening of the triangular support portion 110*d* may be fully open, partially open, or fastened by any mechanism to facilitate removability of the insert 110*e*, such as with Velcro, zipper, snap buttons, or other closures as understood by a person of ordinary skill in the art. Additionally, the insert 110*e* may have Velcro or other closure means attached to it to facilitate it staying in place when positioned in the triangular support portion 110*d* of the crossover belly panel 100.

Figure 2C:
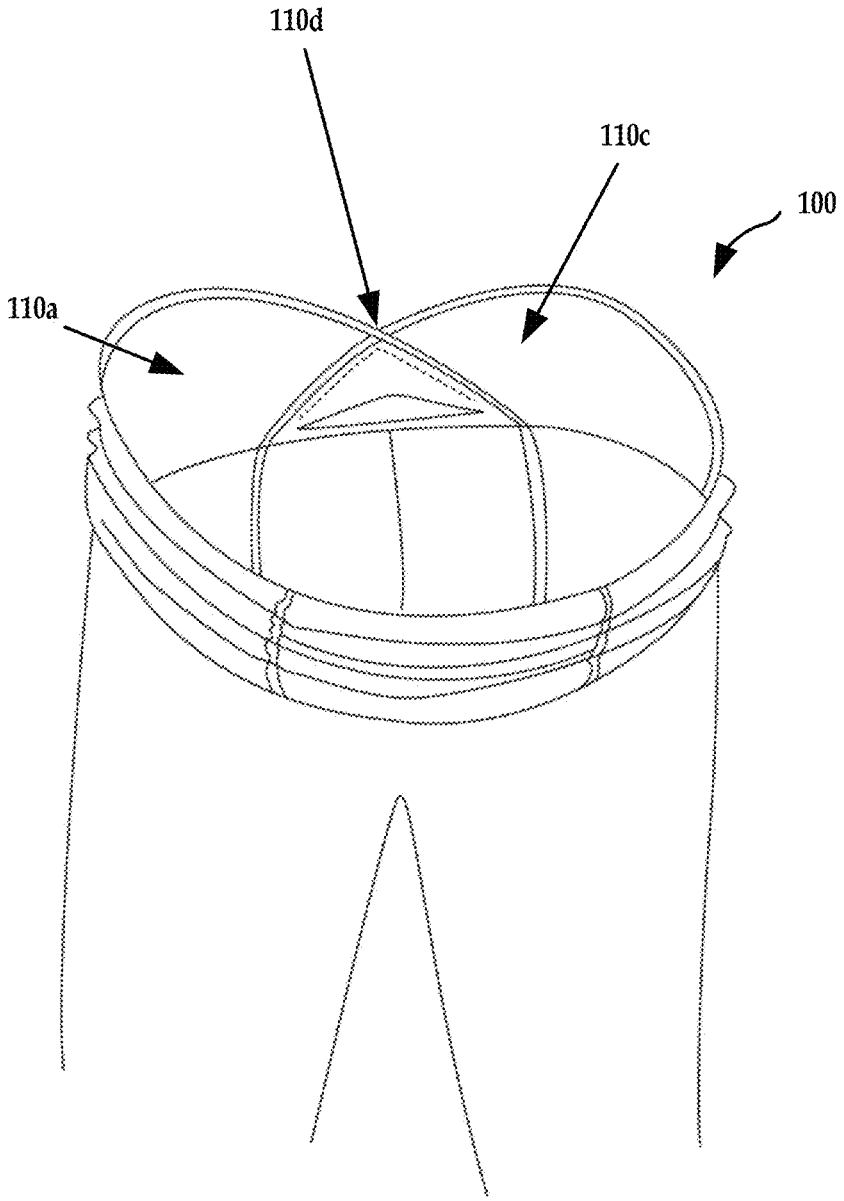
FIG. 2C illustrates an exemplary inside view of a crossover maternity panel with an opening for an insert.

FIG. 2C depicts an exemplary inside view of a crossover belly panel 100 with an opening for insert 110*e*. In the exemplary figure, the triangular support portion 110*d* may be stitched around the edges such that it forms a separate fabric portion from the rest of the crossover belly panel 100. The stitching may form an inverted "v" shape. The insert 110*e* may be positioned for placement in the crossover belly panel 100 between the first and second layers of fabric from the body of the wearer, if fabric portions 110*a* and 110*c* are constructed from a double ply material. The opening of the triangular support portion 110*d* may be fully open, partially open, or fastened by any mechanism to facilitate removability of the insert 110*e*, such as with Velcro, zipper, snap buttons, or other closures as understood by a person of ordinary skill in the art. While the opening for the insert is shown in the figure near the bottom of the triangular support portion 110*d*, it may alternatively be located on either side of the triangular support portion 110*d*. In further embodiments, there may be multiple openings on the triangular support portion 110*d* such that the wearer of the garment may have the option of placing the insert 110*e* in any manner most comfortable.

In other embodiments, the opening for insert 110*e* may be positioned for placement in the crossover belly panel 100 between the third and fourth layers of fabric from the body of the wearer, if fabric portions 110*a* and 110*c* are constructed from a double ply material.

The insert 110*e* depicted in FIGS. 2B and 2C may be constructed of ethylene vinal acetate (EVA) closed cell foam, polyethylene closed cell foam, open cell foam, fabric, cardboard, plastic, or any other singular or composite material. In various embodiments, the insert 110*e* may be flexible, rigid, or semi-rigid. The insert 110*e* may further have a rigid backing on one surface, made from any rigid material such as plastic. The insert 110*e* may additionally be lightweight, and have other properties such as being odor-resistant, moisture wicking, and/or waterproof. The insert 110*e* may be enclosed in a surrounding container, such as a plastic or fabric bag, or may be a standalone item. It may be of varying thickness, ranging from about 0.2 inches to 0.5 inches. If in a triangular or rectangular shape, it may further have hard edges or rounded edges. The bottom of an exemplary triangular insert embodiment may range from about 2.5 to 3.5 inches wide. The height of an exemplary triangular insert may range from about 1.5 to 2.5 inches tall.

As discussed herein, the insert 110*e* in the triangular support portion 110*d* may allow for further support to the wearer's back at the region of the triangular support portion 110*d*. The combination of the crossover design of the crossover belly panel 100 with the stress of the fabric when the wearer's belly grows in front allows the insert to apply subtle yet gentle pressure against the lower back of the wearer. Furthermore, physical activity and daily movement may additionally help the insert 110*e* to exert pressure on the region of the wearer's back where the triangular support portion 110*d* is placed.

In the drawings, FIG. 4 illustrates an exemplary front view of one embodiment of a maternity pant 400 incorporating a crossover maternity panel 410. The maternity pant 400 comprises an upper portion that is a crossover belly panel 410, and a lower portion 420 that is a pant. In various embodiments, the crossover belly panel 410 and the lower portion 420 may be manufactured from the same material, or a different material. The upper portion 410 may be manufactured similarly to, and have substantially the same properties as, the crossover maternity panel 100 as described above.

In exemplary embodiments, the lower portion 420 may be a pant of a straight leg fit from the pelvic ring, or drop waist 450 to the ankle 460, such that the circumference of each pant leg is uniform throughout. The lower portion 420 may also be of a tapered leg configuration such that the circumference of each pant leg becomes smaller from the waist 450 to the ankle 460. In other embodiments, the pant legs may be of a skinny, slim fit, bootcut, flare, legging, or any other configuration. The pelvic ring or drop waist 450 and ankle 460 of the maternity pant 400 may be defined by a seam, a hemline, a fold in the fabric of the garment, a change in pattern, design or color of the garment, or by any other means. The lower portion 420 may range from approximately 25 inches to 48 inches in height 440. The lower portion 420 may be of the same color or design as the upper portion 410, or a different color or design.

Figure 5:
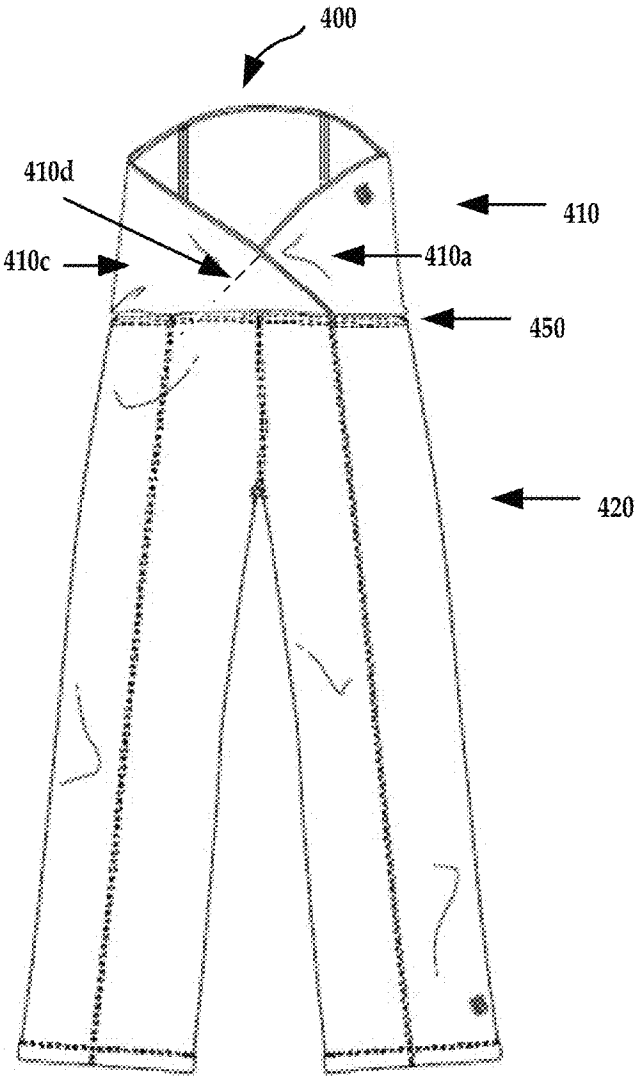
FIG. 5 illustrates an exemplary rear view of one embodiment of a pant incorporating a crossover maternity panel.

FIG. 5 illustrates an exemplary rear view of one embodiment of the maternity pant 400. In the rear view, the crossover portion of the crossover belly panel 410 is shown. The crossover portion may be manufactured such that the portion on the wearer's left side 410*c* overlaps over the portion on the wearer's right side 410*a*. In other embodiments, the portion on the wearer's right side 410*a* may overlap over the portion on the wearer's left side 410*c*. The overlapping of the two portions creates a triangular support portion 410*d* which may fall approximately at the top of the iliac crest (top of pelvis) of the wearer. The seam at the pelvic ring or drop waist 450 may be strategically located to meet approximately at the iliac crest of the wearer of the maternity pant 400.

In an exemplary embodiment, the maternity pant 400 may have strategically designed flatlock seams tracing the contour of the lower portion 420, then following up and around to approximately the iliac crest of the wearer, and connecting to the rear of the crossover belly panel 410.

The crossover belly panel 410 traces the contour of the lower back of the wearer to sweep up and around to the front of the wearer and top of the belly using the lumbar region as a natural platform. The crossover belly panel 410 may consist of a double layer of fabric to hold the belly with comfort during the physical changes of pregnancy. Thus, the triangular support portion 410*d* may provide a total of four layers of fabric in the overlapping region to provide additional support to the wearer's lower back. The sides of the crossover belly panel 410 may also provide a built-in framework for the expanding belly. Additionally, a seam at the pelvic ring or drop waist 450 may be in a subtle arc shape instead of strictly horizontal, such that the crossover belly panel 410 may provide additional comfort and support to the wearer's belly, and be in an optimal location for the best common fit to accommodate the growth of the pregnant belly.

As the belly area of a pregnant woman grows, the crossover belly panel 410 may also expand due to its stretchable and flexible fabric makeup. The expansion of the crossover belly panel 410 may allow it to become more snug, and provide a lifting feeling to the front of the wearer's belly while also simultaneously providing a subtle inward push against the lumbar region of the wearer at the triangular support portion 410*d*. This may provide additional support to the wearer's entire belly region, including lower belly and lumbar regions, as the belly grows and additional support is needed.

FIG. 6 illustrates an exemplary front view of another embodiment of a maternity pant 600 incorporating a crossover maternity panel 610. The maternity pant 600 comprises an upper portion that is a crossover belly panel 610, and a lower portion that is a pant 620. In various embodiments, the crossover belly panel 610 and the lower portion 620 may be manufactured from the same material, or a different material. The upper portion 610 may be manufactured similarly to, and have substantially the same properties as, the crossover maternity panel 100 as described above.

In exemplary embodiments, the lower portion 620 may be of a straight leg fit from the pelvic ring or drop waist 650 to the bottom 660, such that the circumference of each pant leg is uniform throughout. The lower portion 620 may also be of a tapered leg configuration such that the circumference of each pant leg becomes smaller from the pelvic ring or drop waist 650 to the bottom 660. In other embodiments, the pant legs may be of a slim fit, legging, or any other configuration. The pelvic ring or drop waist 650 and bottom 660 of the maternity pant 600 may be defined by a seam, a hemline, a fold in the fabric of the garment, a change in pattern, design or color of the garment, or by any other means. The lower portion 620 may be a capri length such that the bottom 660 is placed just above the knee of the wearer, below the knee of the wearer, or at a point between the wearer's knee and ankle. The lower portion 620 may range from approximately 19 inches to 42 inches in height 640.

Figure 7:
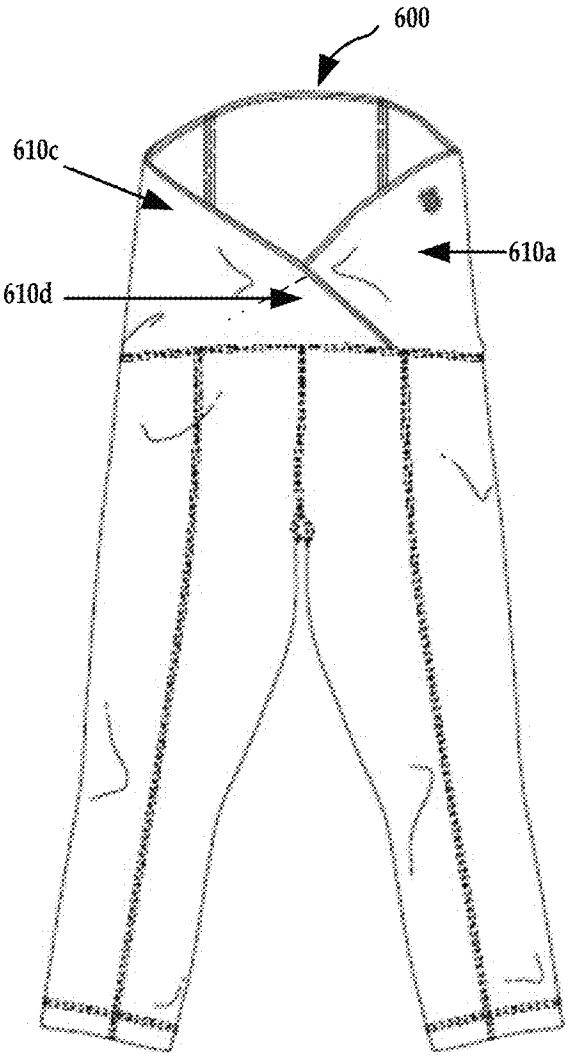
FIG. 7 illustrates an exemplary rear view of another embodiment of a pant incorporating a crossover maternity panel.

FIG. 7 illustrates an exemplary rear view of an embodiment of the maternity pant 600. In the rear view, the crossover portion of the crossover belly panel 610 is shown. The crossover portion may be manufactured such that the portion on the wearer's left side 610*c* overlaps over the portion on the wearer's right side 610*a*. In other embodiments, the portion on the wearer's right side 610*a* may overlap over the portion on the wearer's left side 610*c*. The overlapping of the two portions creates a triangular support portion 610*d* which may fall approximately at the top of the iliac crest (top of pelvis) of the wearer. The seam at the pelvic ring or drop waist 650 may be strategically located to meet approximately at the iliac crest of the wearer of the maternity pant 600.

FIG. 8 illustrates an exemplary front view of another embodiment of a maternity pant 800 incorporating a crossover maternity panel 810. The maternity pant 800 comprises an upper portion that is a crossover belly panel 810, and a lower portion 820 that is a short pant. In various embodiments, the crossover belly panel 810 and the lower portion 820 may be manufactured from the same material, or a different material. The upper portion 810 may be manufactured similarly to, and have substantially the same properties of the crossover maternity panel 100 as described above.

In exemplary embodiments, the lower portion 820 may be of a straight leg fit from the pelvic ring or drop waist 850 to the bottom 860, such that the circumference of each pant leg is uniform throughout. The lower portion 820 may also be of a tapered leg configuration such that the circumference of each pant leg becomes smaller from the pelvic ring or drop waist 850 to the bottom portion 860. In other embodiments, the pant legs may be of a slim fit, legging, or any other configuration. The pelvic ring or drop waist 850 and bottom 860 of the maternity pant 800 may be defined by a seam, a hemline, a fold in the fabric of the garment, a change in pattern, design or color of the garment, or by any other means. The lower portion 820 may be the length of shorts such that the bottom 860 is placed above the knee of the wearer. The lower portion 820 may range from approximately 4 inches to 36 inches in height 840. The lower portion 820 may be of the same color or design as the upper portion 810, or a different color or design.

Figure 9:
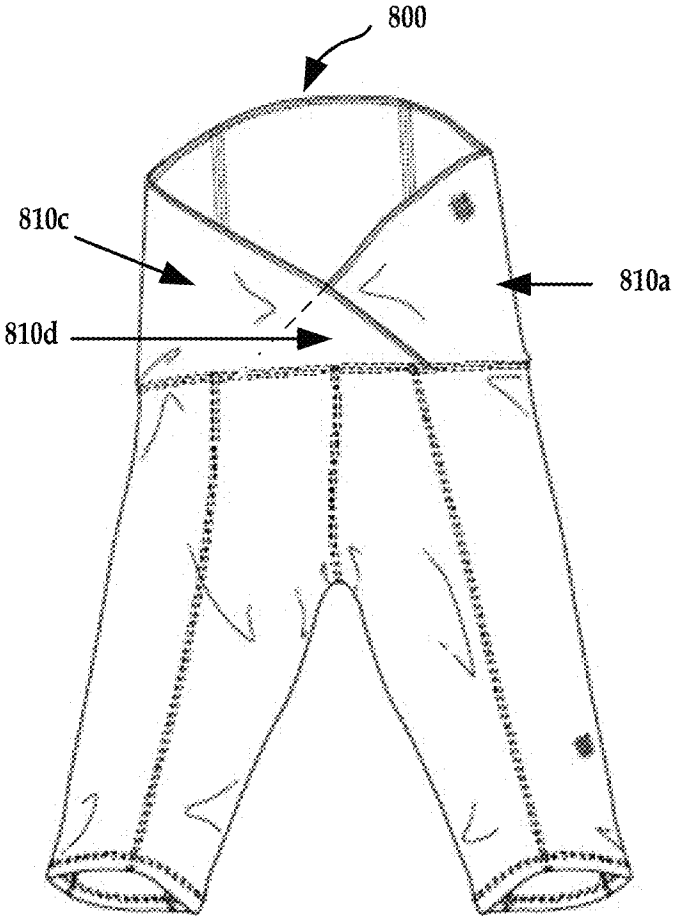
FIG. 9 illustrates an exemplary rear view of a third embodiment of a pant incorporating a crossover maternity panel.

FIG. 9 illustrates an exemplary rear view of an embodiment of the maternity pant 800. In the rear view, the crossover portion of the crossover belly panel 810 is shown. The crossover portion may be manufactured such that the portion on the wearer's left side 810*c* overlaps over the portion on the wearer's right side 810*a*. In other embodiments, the portion on the wearer's right side 810*a* may overlap over the portion on the wearer's left side 810*c*. The overlapping of the two portions creates a triangular support portion 810*d* which may fall approximately at the top of the iliac crest (top of pelvis) of the wearer. The seam at the pelvic ring or drop waist 850 may be strategically located to meet at the iliac crest of the wearer of the maternity pant 800.

In an exemplary embodiment, the maternity pant 800 may have strategically designed flatlock seams tracing the contour of the pant portion 820, then following up to the iliac crest and connecting to the rear of the crossover belly panel 810. The crossover belly panel 810 traces the contour of the lower back of the wearer to sweep up and around to the front of the wearer and top of the belly using the lumbar region as a natural platform. The crossover belly panel 810 may consist of a double layer of fabric to hold the belly with comfort during the physical changes of pregnancy. Thus, the triangular support portion 810*d* may provide a total of four layers of fabric in the overlapping region to provide additional support to the wearer's lower back. The sides of the crossover belly panel 810 may also provide a built-in framework for the expanding belly. Additionally, a seam at the pelvic ring or drop waist 850 may be in a subtle arc shape instead of strictly horizontal, such that the crossover belly panel 810 may provide additional comfort and support to the wearer's belly, and be in an optimal location for the best common fit.

FIG. 10 illustrates an exemplary front view of another embodiment of a maternity garment 1000 incorporating a crossover maternity panel 1010. The maternity garment 1000 comprises an upper portion that is a crossover belly panel 1010, and a lower portion 1020 that is a skirt. In various embodiments, the crossover belly panel 1010 and the lower portion 1020 may be manufactured from the same material, or a different material. The upper portion 1010 may be manufactured similarly to, and have substantially the same properties as, the crossover maternity panel 100 as described above.

In exemplary embodiments, the lower portion 1020 may be a skirt of any shape from the pelvic ring or drop waist 1050 to the bottom 1060. The skirt may be of a straight fit, such that the circumference from the pelvic ring or drop waist 1050 to the bottom 1060 is uniform throughout. The skirt may also be of an A-line shape, flare, or any other shape. The pelvic ring or drop waist 1050 and bottom 1060 of the maternity garment 1000 may be defined by a seam, a hemline, a fold in the fabric of the garment, a change in pattern, design or color of the garment, or by any other means. The skirt may also be of any length from above the knee of the wearer to below the ankle of the wearer. The crossover belly panel 1010 may be of the same color or design as the lower portion 1020, or a different color or design. When the lower portion 1020 is a skirt, the skirt may be seamless, or have one or more seams running vertically along the length of the skirt.

Figure 11:
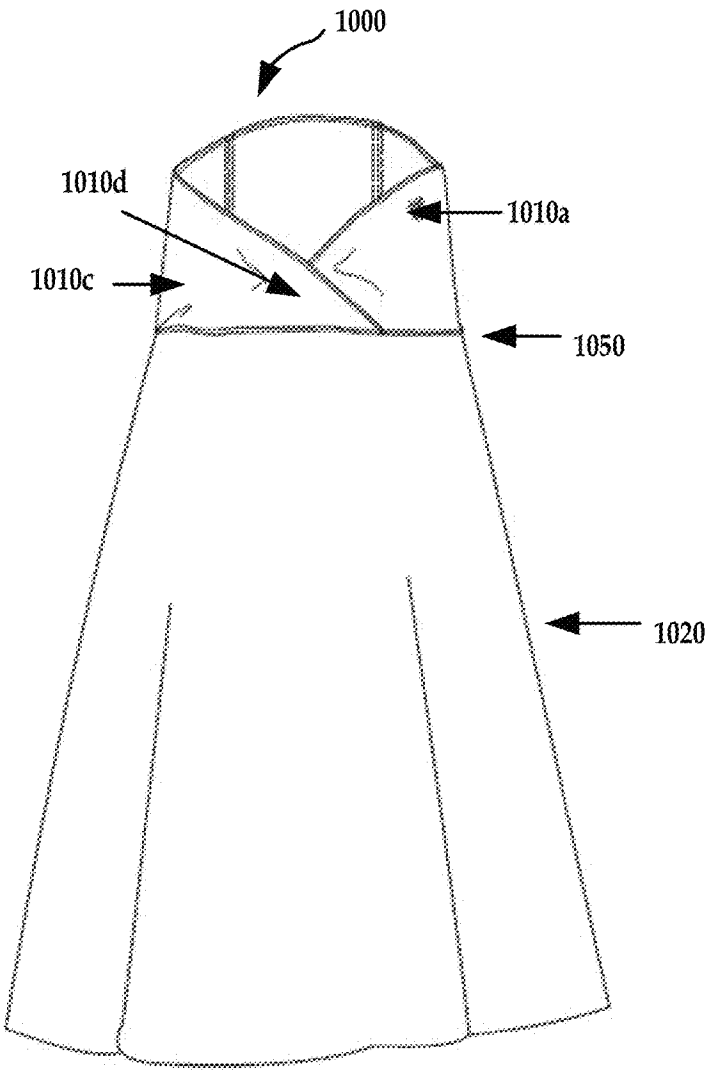
FIG. 11 illustrates an exemplary rear view of one embodiment of a skirt incorporating a crossover maternity panel.

FIG. 11 illustrates an exemplary rear view of one embodiment of the maternity garment 1000. In the rear view, the crossover portion of the crossover belly panel 1010 is shown. The crossover portion may be manufactured such that the portion on the wearer's left side 1010*c* overlaps over the portion on the wearer's right side 1010*a*. In other embodiments, the portion on the wearer's right side 1010*a* may overlap over the portion on the wearer's left side 1010*c*. The overlapping of the two portions creates a triangular support portion 1010*d* which may fall approximately at the top of the iliac crest (top of pelvis) of the wearer. The seam at the pelvic ring or drop waist 1050 may be strategically located to meet approximately at the iliac crest of the wearer of the maternity garment 1000.

The combination of a double ply crossover belly panel 1010 with deliberately placed structural seams at the pelvic ring or drop waist level 1050 on the lower back provide increased comfort and mobility for the wearer due to the combination of the triangular support panel 1010*d* and the elasticity of the fabric blend. In an exemplary embodiment, the maternity garment 1000 may have strategically designed flatlock seams tracing the contour of the lower portion 1020, then following up and around to approximately the iliac crest of the wearer, and connecting to the rear of the crossover belly panel 1010.

The crossover belly panel 1010 traces the contour of the lower back of the wearer to sweep up and around to the front of the wearer and top of the belly using the lumbar region as a natural platform. The crossover belly panel 1010 may consist of a double layer of fabric to hold the belly with comfort during the physical changes of pregnancy. Thus, the triangular support panel 1010*d* may provide a total of four layers of fabric in the overlapping region to provide additional support to the wearer's lower back. The sides of the crossover belly panel 1010 may also provide a built-in framework for the expanding belly. Additionally, a seam at the pelvic ring or drop waist 1050 may be in a subtle arc shape instead of strictly horizontal, such that the crossover belly panel 1010 may provide additional comfort and support to the wearer's belly, and be in an optimal location for the best common fit.

Figure 12:
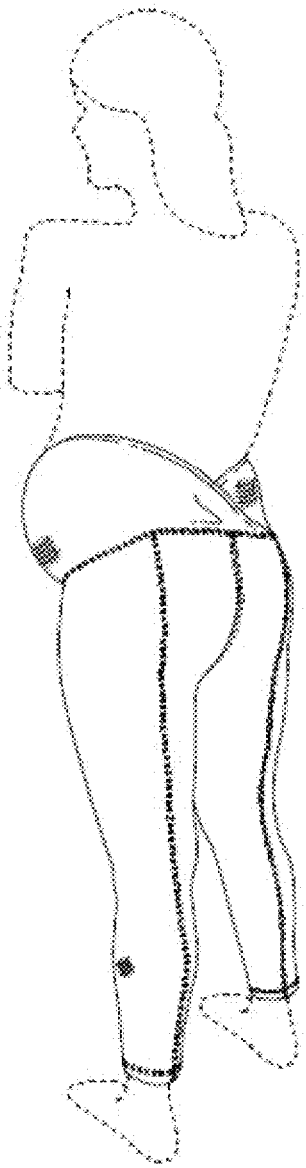
FIG. 12 illustrates an exemplary embodiment of a pregnant woman wearing a pant incorporating a crossover maternity panel.
Figure 13:
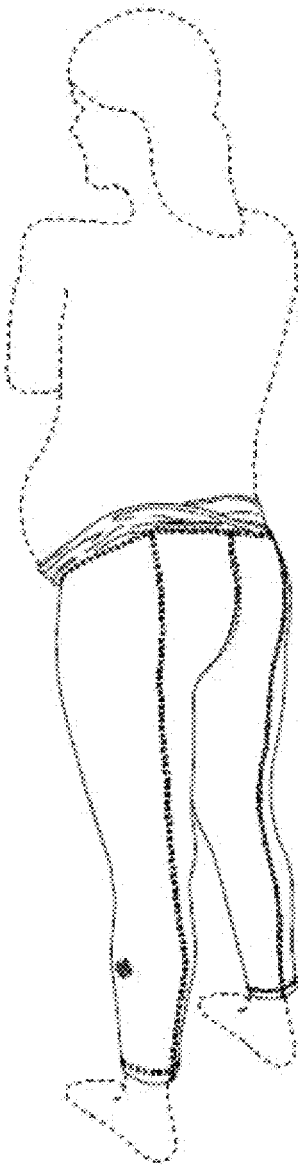
FIG. 13 illustrates an exemplary embodiment of a pregnant woman wearing a pant incorporating a crossover maternity panel with the panel folded.
Figure 14:
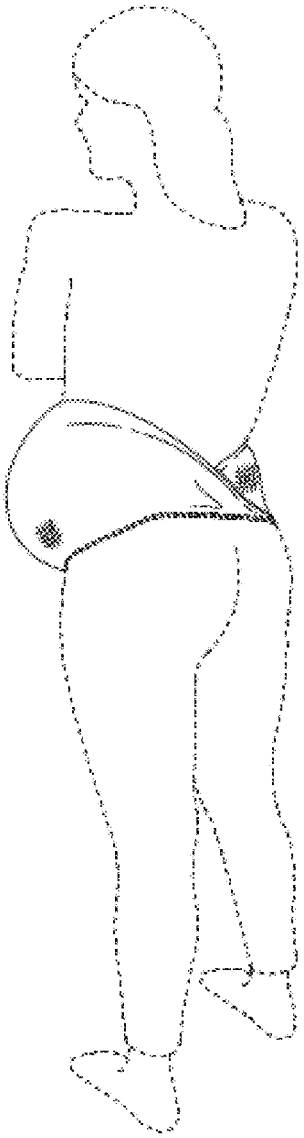
FIG. 14 illustrates an exemplary embodiment of a pregnant woman wearing a pant incorporating a crossover maternity panel.
Figure 15:
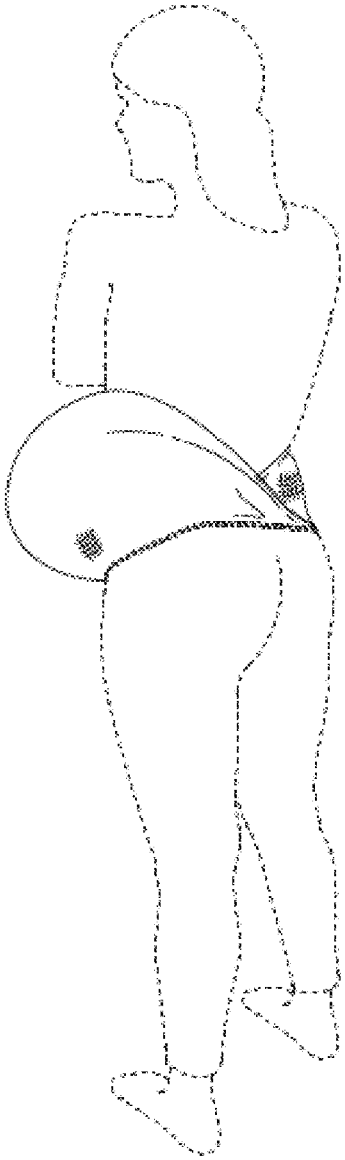
FIG. 15 illustrates an exemplary embodiment of a pregnant woman wearing a pant incorporating a crossover maternity panel.

FIG. 12 illustrates an exemplary embodiment of a pregnant woman wearing a maternity pant 400. FIG. 13 illustrates an exemplary embodiment of a pregnant woman wearing a maternity pant 400 with the crossover belly panel 410 folded down. In this configuration, the folded layers of the crossover belly panel 410 provide additional support from below the belly, while also maintaining the support on the wearer's lumbar region in the back. FIGS. 14 and 15 illustrate an exemplary embodiment of a woman in later stages of pregnancy wearing a maternity pant 400. The figures illustrate the stretch of the crossover belly panel 410 as the wearer's belly grows into an increasingly swollen belly.

The above described embodiments are intended to illustrate the principles of the invention, but not to limit its scope. Other embodiments and variations to these embodiments will be apparent to those skilled in the art and may be made without departing from the spirit and scope of the invention as defined in the following claims. It will be further understood that the methods of the invention are not necessarily limited to the discrete steps or the order of the steps described. To the contrary, the present descriptions are intended to cover such alternatives, modifications, and equivalents as may be included within the spirit and scope of the invention as defined by the appended claims and otherwise appreciated by one of ordinary skill in the art.

What is claimed is:

1. A crossover maternity panel made from a flexible and stretchable material configured to be worn around a midsection of a woman's body, the panel comprising:

a left portion of fabric configured to cover a left portion of the woman's body when the panel is worn;

the left portion of fabric having an upper terminal end that is configured to be positioned either on or above a woman's swollen belly and a lower terminal end at a bottom edge of the crossover maternity panel near a waistband of a bottom garment configured to cover at least a portion of legs of the woman;

the left portion of fabric further decreasing in height as the left portion wraps around from a front of the woman's body to a back of the woman's body;

a front middle portion of fabric configured to cover a front middle portion of the woman's body when the panel is worn;

the front middle portion of fabric having an upper terminal end that is configured to be positioned either on or above the woman's swollen belly and a lower terminal end at the bottom edge of the crossover maternity panel near the waistband of the bottom garment configured to cover at least a portion of the legs of the woman; and a right portion of fabric configured to cover a right portion of the woman's body when the panel is worn;

the right portion of fabric having an upper terminal edge that is configured to be positioned either on or above the woman's swollen belly and a lower terminal end at the bottom edge of the crossover maternity panel near the waistband of the bottom garment configured to cover at least a portion of the legs of the woman, the right portion of fabric further decreasing in height as the right portion wraps around from the front of the woman's body to the back of the woman's body;

wherein a left portion of the panel crosses over or under a right portion of the panel at a midline of the back of the woman's body when the crossover maternity panel is worn, forming a substantially triangular portion created by an overlapping of the left portion of the panel and the right portion of the panel at the back of the woman's body, and wherein the upper terminal end of the front middle portion of fabric is of an arcuate shape, the arcuate shape having a greatest height dimension approximately at a midpoint of the front middle portion, the arcuate shape curving downwardly towards the left portion and towards the right portion.

2. The crossover maternity panel of claim 1, wherein the substantially triangular portion of the crossover maternity panel further comprises an opening for insertion of an insert material.

3. The crossover maternity panel of claim 1, wherein the upper terminal end of the left portion of fabric is of an arcuate shape, and the upper terminal end of the right portion of fabric is of an arcuate shape.

4. The crossover maternity panel of claim 1, wherein the left portion and the right portion decrease to zero height where connected to the bottom edge of the crossover maternity panel at the back of the woman's body.

5. The crossover maternity panel of claim 1, wherein at least one seam separates the left portion of fabric from the front middle portion of fabric.

6. The crossover maternity panel of claim 1, wherein at least one seam separates the right portion of fabric from the front middle portion of fabric.

7. The crossover maternity panel of claim 1, wherein the left portion of fabric, front middle portion of fabric, and right portion of fabric all comprise a single seamless knit tube.

8. The crossover maternity panel of claim 1, wherein the flexible and stretchable material is a knit tube.

9. The crossover maternity panel of claim 1, wherein the flexible and stretchable material is a knit fabric blend comprising spandex with at least one of rayon, nylon, cotton, and polyester.

10. The crossover maternity panel of claim 1, wherein the flexible and stretchable material is a blend comprising polyester/viscose and spandex.

11. The crossover maternity panel of claim 1, wherein the substantially triangular portion has a lateral width of 2-15 inches at the bottom edge of the crossover maternity panel at the back of the woman's body.

12. The crossover maternity panel of claim 1, wherein the flexible and stretchable material has a fabric density of 130-350 $g/m^2$.

13. The crossover maternity panel of claim 1, wherein the front middle portion of fabric has a height ranging from 8 inches to 16 inches.

14. The crossover maternity panel of claim 1, wherein the bottom edge of the crossover maternity panel is attached to a top edge of the bottom garment.

15. The crossover maternity panel of claim 1, wherein the bottom edge of the crossover maternity panel is configured to be placed near a top edge of the bottom garment when the panel is worn.

16. The crossover maternity panel of claim 1, wherein the flexible and stretchable material is moisture wicking.

17. The crossover maternity panel of claim 1, wherein the flexible and stretchable material is antimicrobial.

18. The crossover maternity panel of claim 1, wherein the flexible and stretchable material comprises a first layer and a second layer of material.

19. A crossover maternity panel made from a flexible and stretchable material, the panel comprising:

at least one portion of fabric configured to meet a bottom garment, the at least one portion of fabric comprising at least one of a left portion of fabric, a front middle portion of fabric, and a right portion of fabric, the bottom garment configured to cover a left portion, a front portion, and a right portion of a woman's swollen belly when the crossover maternity panel is worn;

the left portion of fabric configured to cover a left portion of the woman's body when the panel is worn, the left portion of fabric having an upper terminal end that is configured to be positioned either on or above a woman's swollen belly and a lower terminal end at a bottom edge of the crossover maternity panel near a waistband of the bottom garment configured to cover at least a portion of legs of the woman;

the left portion of fabric further decreasing in height as the left portion wraps around from a front of the woman's body to a back of the woman's body;

the front middle portion of fabric configured to cover a front middle portion of the woman's body when the panel is worn;

the front middle portion of fabric having an upper terminal end that is configured to be positioned either on or above the woman's swollen belly and a lower terminal end at the bottom edge of the crossover maternity panel near the waistband of the bottom garment configured to cover at least a portion of the legs of the woman; and the right portion of fabric configured to cover a right portion of the woman's body when the panel is worn, the right portion of fabric having an upper terminal edge that is configured to be positioned either on or above the woman's swollen belly and a lower terminal end at the bottom edge of the crossover maternity panel near the waistband of the bottom garment configured to cover at least a portion of the legs of the woman, the right portion of fabric further decreasing in height as the right portion wraps around from the front of the woman's body to the back of the woman's body;

wherein a left portion of the panel crosses over or under a right portion of the panel at a midline of the back of the woman's body when the crossover maternity panel is worn, forming a substantially triangular portion created by an overlapping of the left portion of the panel and the right portion of the panel at the back of the woman's body, and wherein the upper terminal end of the front middle portion of fabric is of an arcuate shape, the arcuate shape having a greatest height dimension approximately at a midpoint of the front middle portion, the arcuate shape curving downwardly towards the left portion and towards the right portion.

* * * * *